US011495079B2

(12) United States Patent
Gaafar et al.

(10) Patent No.: US 11,495,079 B2
(45) Date of Patent: Nov. 8, 2022

(54) AUTOMATIC VENDING MACHINE FOR BEVERAGE CANS

(71) Applicant: Anheuser-Busch InBev S.A., Brussels (BE)

(72) Inventors: Robert Gaafar, New York, NY (US); Maisie Devine, New York, NY (US); Patrick O'Riordan, New York, NY (US); Hilary Farnsworth, Hauppage, NY (US); Peter Daily, Hauppage, NY (US); Doreen Swift, Hauppage, NY (US); Ralph Cassara, Hauppage, NY (US); Joseph Toro, Hauppage, NY (US); Glenn Drost, Hauppage, NY (US); Rodney McGaugh, Hauppage, NY (US)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 16/643,702

(22) PCT Filed: Aug. 31, 2018

(86) PCT No.: PCT/EP2018/073468
§ 371 (c)(1),
(2) Date: Mar. 2, 2020

(87) PCT Pub. No.: WO2019/043158
PCT Pub. Date: Mar. 7, 2019

(65) Prior Publication Data

US 2020/0211314 A1 Jul. 2, 2020

(30) Foreign Application Priority Data

Sep. 1, 2017 (BE) ..... 2017/5610

(51) Int. Cl.
*G07F 13/10* (2006.01)
*B67B 7/40* (2006.01)
*G07F 9/10* (2006.01)

(52) U.S. Cl.
CPC ..... *G07F 13/10* (2013.01); *B67B 7/403* (2013.01); *G07F 9/105* (2013.01)

(58) Field of Classification Search
CPC ..... G07F 9/105; G07F 13/10; G07F 11/24; G07F 11/72; G07F 11/10; B67B 7/403
(Continued)

(56) References Cited

U.S. PATENT DOCUMENTS 2,765,005 A * 10/1956 Wellekens ..... G07F 13/065 221/124
2,771,215 A * 11/1956 Opgenorth ..... G07F 11/10 221/116
(Continued)

FOREIGN PATENT DOCUMENTS

CN 204802964 U 11/2015
DE 102005006562 A1 8/2006
(Continued)

OTHER PUBLICATIONS

EPO, Communication for EP Application No. 18762832.6, dated Jun. 21, 2021.
(Continued)

*Primary Examiner* — Rakesh Kumar
(74) *Attorney, Agent, or Firm* — Carter, DeLuca & Farrell LLP; George Likourezos

(57) ABSTRACT

The present disclosure provides an automatic vending machine for dispensing beverage cans. The machine includes a main housing having a can delivery slot. The housing includes a refrigerant compartment for storing the beverage cans. The housing further includes a delivery
(Continued)

sub-system for delivering a beverage can from the refrigerant compartment to the delivery slot accessible to a consumer. The delivery sub-system is configured to orient and open the can while delivering to the delivery slot.

18 Claims, 15 Drawing Sheets

(58) Field of Classification Search
USPC ..... 221/1
See application file for complete search history.

(56) References Cited

U.S. PATENT DOCUMENTS 2,825,488 A * 3/1958 Nelson ..... G07F 9/10 219/214
2,851,324 A * 9/1958 Wellekens ..... G07F 11/28 312/45
2,918,196 A * 12/1959 Lebron ..... A47F 1/10 221/124
2,952,202 A * 9/1960 Renner ..... A47J 31/3628 222/83.5
2,958,942 A * 11/1960 Fazekas ..... B67B 7/24 219/229
2,989,994 A * 6/1961 Morris ..... G07F 13/065 221/199
3,080,078 A * 3/1963 Carew ..... B67B 7/38 414/412
3,447,662 A * 6/1969 House ..... B65B 35/56 198/395
3,710,922 A * 1/1973 Lanphere ..... B65G 47/256 198/398
3,710,978 A 1/1973 Cosby
3,752,357 A 8/1973 Harris
3,805,643 A * 4/1974 Turner ..... B67B 7/406 30/400
4,108,333 A * 8/1978 Falk ..... G07F 9/105 221/13
4,717,044 A * 1/1988 Suzuki ..... G07D 1/00 221/195
5,050,723 A * 9/1991 Herzog ..... B65G 47/248 198/395
5,107,728 A 4/1992 Siekierke
5,255,775 A * 10/1993 Buehren ..... B65G 47/24 198/395
5,555,778 A * 9/1996 Otters ..... B67B 7/406 D8/40
5,916,337 A * 6/1999 Caniglia ..... B65D 17/4012 81/3.15
6,186,398 B1 2/2001 Kato et al.
6,199,720 B1 * 3/2001 Rudick ..... G07F 11/32 221/6
6,286,715 B1 * 9/2001 Ziesel ..... G07F 9/02 221/253
6,499,627 B2 * 12/2002 Arai ..... G07F 11/62 221/253
6,575,325 B2 6/2003 Dickie et al.
6,648,123 B1 11/2003 Rustad
6,682,289 B1 * 1/2004 Credle, Jr. ..... G07F 11/163 221/95
6,808,082 B2 * 10/2004 Ohkubo ..... G07F 11/58 221/133
6,945,137 B1 * 9/2005 Hawkins ..... B67B 7/406 81/3.55
7,123,989 B2 * 10/2006 Pinney ..... G07F 9/026 700/216
7,299,943 B2 * 11/2007 Itoh ..... B01L 9/543 221/242
7,783,378 B2 * 8/2010 Pinney ..... G07F 11/62 700/242
7,802,700 B2 * 9/2010 Ardern ..... G07F 11/1653 221/124
7,837,058 B2 * 11/2010 Collins ..... G07F 11/42 221/9
7,837,059 B2 * 11/2010 Hieb ..... G07F 11/10 221/133
7,905,340 B2 3/2011 Monti
8,162,174 B2 * 4/2012 Hieb ..... G07F 11/32 221/133
8,342,361 B2 * 1/2013 Cooper ..... G07F 11/58 221/133
8,469,230 B2 * 6/2013 Perkins ..... G07F 11/1653 221/196
8,534,494 B2 * 9/2013 Black, Jr. ..... G07F 9/026 221/133
8,820,574 B2 * 9/2014 Howell ..... G07F 9/026 221/9
9,104,990 B2 * 8/2015 Lowe ..... G06Q 30/0645
9,741,196 B2 * 8/2017 Yamagami ..... G07F 11/08
9,870,671 B1 * 1/2018 Lad ..... G07F 11/165
10,332,331 B2 6/2019 Li et al.
10,490,014 B2 * 11/2019 Jafa ..... G07F 11/165
11,096,519 B2 * 8/2021 Hiatt ..... A47J 36/24
2004/0089105 A1 5/2004 Saviano et al.
2009/0078718 A1 3/2009 Kirschner
2009/0152287 A1 * 6/2009 Saba ..... G07F 17/0071 221/9
2010/0140286 A1 * 6/2010 Quinn ..... F25B 27/007 62/236
2010/0243666 A1 * 9/2010 Skavnak ..... G07F 11/165 221/1
2011/0068116 A1 * 3/2011 Ardern ..... G07F 11/163 221/133
2012/0000927 A1 * 1/2012 Carpentier ..... A47F 3/0491 221/97
2012/0097694 A1 4/2012 Gelardi
2013/0112702 A1 * 5/2013 Roekens ..... A47F 3/0486 221/150 R
2015/0197362 A1 7/2015 Sato
2016/0038992 A1 * 2/2016 Arthur ..... B67B 7/403 413/56
2020/0312078 A1 * 10/2020 Deshpande ..... G07F 9/105
2020/0315373 A1 * 10/2020 Deshpande ..... G07F 9/105

FOREIGN PATENT DOCUMENTS

DE 102007027864 A1 12/2008
EP 2256703 A1 12/2010
EP 2286164 A1 2/2011
EP 2610827 A1 7/2013
GB 1300565 12/1972
JP 04364811 A * 12/1992 ..... G07F 11/24
JP H04364811 A 12/1992
JP H07251897 A 10/1995
JP H08110983 A 4/1996
JP 2002056451 A * 2/2002
JP 2002056451 A 2/2002
WO 9605578 A1 2/1996
WO WO-9605578 A1 * 2/1996 ..... G07F 11/10
WO 9802853 A2 1/1998
WO 2016065699 A1 5/2016

OTHER PUBLICATIONS

EPO, Communication for EP Application No. 18759333.0, dated Jun. 18, 2021.
WIPO, International Search Report and Written Opinion for PCT/EP2018/073454, dated Dec. 6, 2018.
WIPO, ISR and WO for PCT/EP2018/073468, dated Oct. 11, 2018.
European Office Action issued in corresponding EP Appln. No. 18 762 832, dated Aug. 2, 2022, 6 pages.
European Office Action issued in corresponding EP Appln. No. 18 759 333, dated Aug. 2, 2022, 5 pages.

* cited by examiner

400

AUTOMATIC VENDING MACHINE FOR BEVERAGE CANS

TECHNICAL FIELD

The present disclosure generally relates to a vending apparatus; and more particularly relates to an automatic vending machine for dispensing an opened beverage can.

BACKGROUND

Containers, such as beverage cans, enclosing liquid foods such as for example, water, beer, beverages, etc. have lately been proved invaluable in a wide array of situations and is currently one of the most retailed product across the globe. Most of the beverages such as juices, beer, wines and others are preferably consumed when cold, ideally around 45° F. for juices, and between 50° F. to 60° F. for wines.

Many places, from industrial to civilian settings, for example in structures such as train stations, hospitals, schools, nightclubs, dance halls, restaurants and refreshment services of various type are equipped with one or more beverage serving stations at which a variety of canned beverages are maintained. Typically, such beverage cans are stocked in refrigerated cabinets or chests behind the serving area to be operated by an operator. When the operator receives an order for a particular canned product, he must open the door to the cabinet or chest, pull out the desired product, and then close the door.

During non-peak business hours, the aforesaid procedure does not pose a particular inconvenience or problem to the operator; however, during peak business hours, operators often have difficulty filling orders at the rate at which such orders are received.

At such times, the necessity to open the door to the cabinet or chest, taking out the beverage can, and subsequently close the door unduly limits the ability of the operator. Furthermore, such storage cabinets or chests have limited capacities and typically must be frequently restocked from a large capacity refrigerated enclosure. Such drinking establishments are not easy, nor fast, nor immediate and may cause substantial delays. Therefore, such drinking establishments have a huge impact upon beverage sales and thus severely curtail income during such peak business hours.

In order to address these concerns, numerous efforts have been made to develop practical systems individually dispensing refrigerated beverage cans without opening the refrigerator door. Some solutions included Vending machines, for example, that accept coins or other forms of payment and then electro-mechanically discharge a refrigerated beverage can for retrieval by a consumer directly from the machine.

At the state of the art, there are automatic vending machines available in the market which have different technologies, both from a structural and functional standpoint. In particular, Beverage can vending machines are known which includes a plurality of columns which are filled with bottles or cans. These vending machines, by using various delivery mechanisms, in an appropriate manner, are capable of positioning the preselected product at a delivery area, which may be accessible by the user for withdrawal thereof. Generally, these machines takes compact space and can be easily installed anywhere like in parks, pedestrians, metro station, air ports etc As stated above, these vending machines have been very successful in the marketplace with respect to achieving their objectives. However, all major currently known vending machines suffer from certain limitations. Such as for example, while the vending machine dispenses can as per the user's selection—the cans are not delivered in a ready to drink mode. The can delivered still requires to be oriented and then opened before they can be drunk.

Various mechanisms have been developed for providing the functionality of vertically orienting the beverage cans at the delivery area. One such mechanism is disclosed in US Publication 3710978. Such mechanism generally include introduction of the beverage cans within the storage compartment of the vending machine in a vertical orientation. Such a requirement is not preferred as it slows down the process of filling the storage compartment. Further, support mechanism have to be utilized in such an arrangement so as to keep the cans stable, thereby making the internal structure of machine, complex and expensive and is not therefore preferred. Some other vending machines included a gripper for picking up a can and delivering it to the delivery area in a vertical orientation.

One of the additional limitations include absence of latest payment techniques for activating these vending machines. Vending machines have traditionally accepted coins and occasionally bank notes in payment for the goods or service they dispense. Various specific prepaid cards have also been introduced for use at specific vending machines. However, it is necessary to introduce a technology where all major known payment mechanisms such as credit cards, debit cards, cash cards including the known spectrum of cashless payment, may be utilized to make the payment at the vending machines A further general problem in the context of beverage can vending machine is the problem of closed beverage cans being used as projectiles on events or in stadiums. If the consumer would not be given the choice to leave the can closed or to open it, it would alleviate the above problem. In addition, it would allow the use of beverage cans, and can vending machines further into the stadium or venue with allayed safety concerns.

JP08110983A disclosed an automatic vending machine with a can opening device which enables any purchaser to easily pull and raise the pull tab of a canned beverage. The can opening device includes an engaging part which is engaged with the pull tab and a holding plate connected to the engaging part extended in the opposite direction of the pull tab and a holding plate support part counterclockwise inclined at about 70° to the holding plate. The can may be opened by first inserting the engaging part to a hole of the pull tab and then pulling and rotating the can to the front, to open the can. While such a can opening device is easy to operate, it still requires a manual action for opening the can and the consumer is not obliged to open the can.

Accordingly, there is a need in the art for an improved can vending machine which while being easy to use, and cost-effective, accepts all latest means of cashless payment and provides the consumer with a properly oriented and properly delivered beverage can, and which does not give the consumer the choice whether to leave the can closed or to open it.

SUMMARY

In one aspect of the present disclosure, an automatic vending machine for dispensing beverage cans, is provided. The machine includes a main housing having a can delivery slot. The housing includes a refrigerant compartment for storing the beverage cans. The housing further includes a delivery sub-system for delivering a beverage can from the refrigerant compartment to the delivery slot accessible to a consumer. The delivery sub-system is configured to orient, and open the can while delivering it to the delivery slot.

Generally, the refrigerant compartment is a generally quadrilateral storage area having a top storage portion and a bottom refrigerant unit.

Preferably, the refrigerant unit includes a set of refrigeration coils, a compressor and a cooling fan for providing the cool air into the top storage portion.

Potentially, the top storage portion comprising a plurality of columns, each column configured to hold a stack of beverage can and having a release door at a lower portion thereof.

Further potentially, the top storage portion comprising a delivery door for passing a beverage can from the refrigerant compartment to the delivery sub-system.

Yet further potentially, the machine comprising a door opening mechanism for opening the delivery door of the refrigerant compartment.

Preferably, the delivery sub-system comprises a receiving station for receiving the can from the refrigerant compartment.

Additionally, the delivery sub-system comprises an elevator station for delivering the can to the delivery slot of the main housing.

Generally, the delivery sub-system comprises an orientation station between the receiving station and elevator station for vertical orienting and placing the can onto a platform of the elevator station.

Further, the delivery sub-system comprises an opening mechanism for opening the beverage can being delivered through the elevator Possibly, the opening mechanism includes a tab orienting mechanism and one/or more opener portion to pull-open the oriented tabs Further possibly, the tab orienting mechanism includes a combination of a friction wheel and a switch idler for orienting a tab of the can placed onto a platform of the elevator station in a direction corresponding to the opener portion Yet further possibly, the opener portion includes one or more radial claws configured to engage the tab of oriented clans while moving upon the elevator.

Additionally, the machine includes a payment interface configured onto the main housing for receiving the payment there through.

In another aspect of the invention, a method for delivering an opened can from vending machine is disclosed. The method include receiving a request for an opened can. The method further include delivering one or more oriented and opened cans from the refrigerant compartment to the delivery slot via the delivery sub-system.

Generally, the method include orienting the beverage can at the orienting station of the vending machine.

Further, the method include opening the beverage can using the can opening mechanism of the vending machine.

The details of one or more implementations are set forth in the accompanying drawings and the description below. Other aspects, features and advantages of the subject matter disclosed herein will be apparent from the description, the drawings, and the claims.

DETAILED DESCRIPTION

As required, a schematic, exemplary-only embodiment of the present application is disclosed herein; however, it is to be understood that the disclosed embodiment is merely exemplary of the present disclosure, which may be embodied in various and/or alternative forms. Specific structural and functional details disclosed herein are not to be interpreted as limiting, but merely as a basis for the claims and as a representative basis for teaching one skilled in the art to variously employ the present disclosure in virtually any appropriately detailed structure.

Aspects, advantages and/or other features of the exemplary embodiment of the disclosure will become apparent in view of the following detailed description, which discloses various non-limiting embodiments of the invention. In describing exemplary embodiments, specific terminology is employed for the sake of clarity. However, the embodiments are not intended to be limited to this specific terminology. It is to be understood that each specific portion includes all technical equivalents that operate in a similar manner to accomplish a similar purpose.

Exemplary embodiments may be adapted for many different purposes and are not intended to be limited to the specific exemplary purposes set forth herein. Those skilled in the art would be able to adapt the exemplary-only embodiment of the present disclosure, depending for example, on the intended use of adapted embodiment. Moreover, examples and limitations related therewith brought herein below are intended to be illustrative and not exclusive. Other limitations of the related art will become apparent to those of skill in the art upon a reading of the following specification and a study of the related figures.

The present application discloses an automatic vending machine for use in dispensing a beverage can enclosing liquids such as cold drinks, beer, wines, mineral water etc in a ready to drink state i.e orients and opens the can for use by a consumer. The machine may generally be used for dispensing any kind of beverage cans, irrespective of carbonation level, alcohol level, viscosity level, for example in company restaurants, school canteens, etc. In particular, the machine of the present invention may be used at venues in general, and in particular in stadiums during sport events and concerts. Further, it should be understood that embodiments of the present invention may be applied in combination with various type of beverage cans irrespective of size, shape and materials, used in the beverage industry. It must also be noted that, as used in this specification and the appended claims, the singular forms "a," "an" and "the" include plural referents unless the context clearly dictates otherwise. Thus, for example, the term "an opening" is intended to mean a single opening or a combination of openings, "a liquid" is intended to mean one or more liquids, or a mixture thereof.

Figure 1:
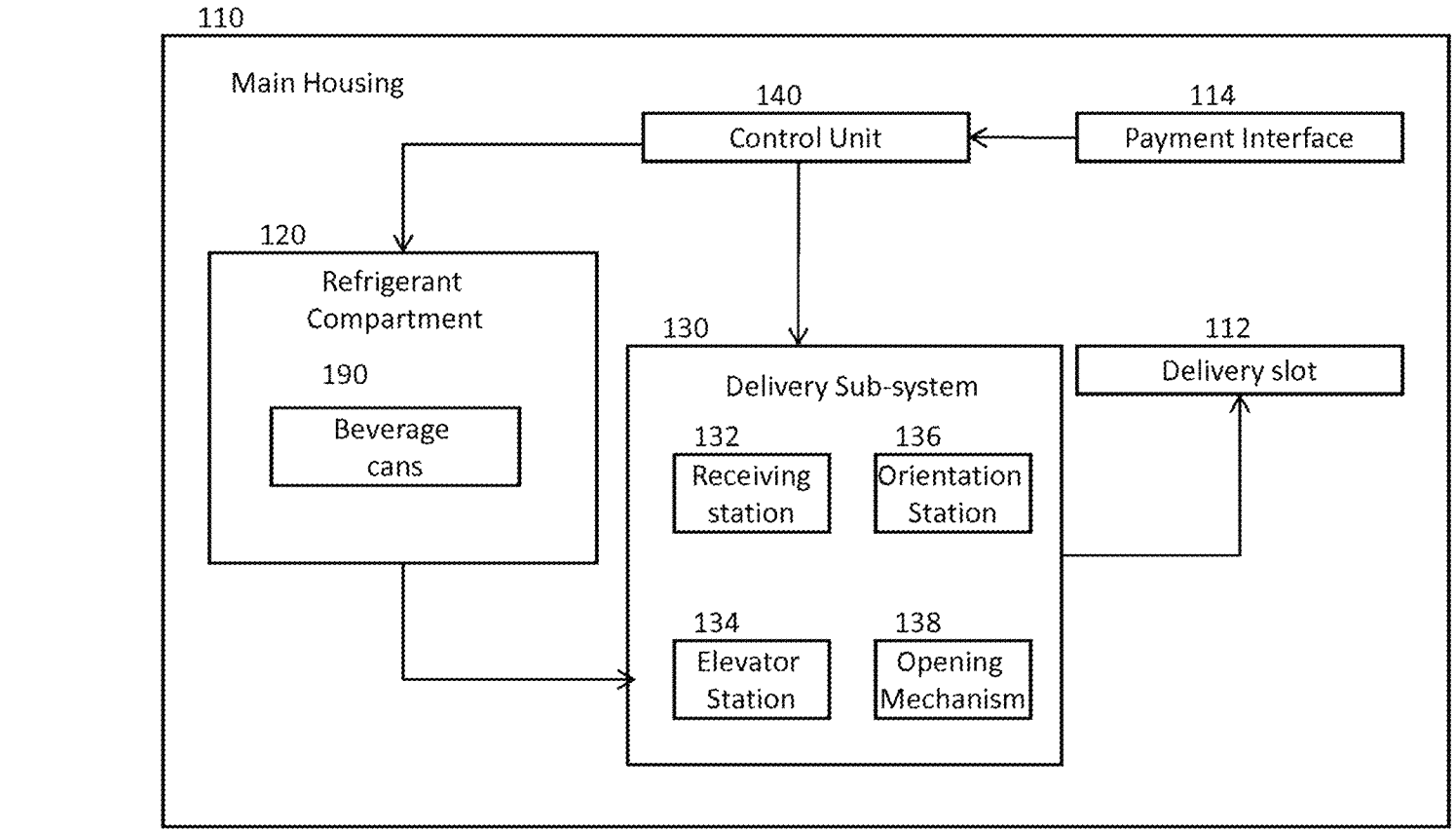
FIG. 1 is a block diagram representing an automatic vending machine, according to one preferred embodiment of the present disclosure.

FIG. 1 depicts a block diagram displaying basic components of the machine of the present disclosure. As illustrated in FIG. 1, the present disclosure provides an automatic vending machine 100 for dispensing one or more of plurality of beverage cans 190. The machine 100 comprises a main housing 110 having a beverage delivery slot 112 and a payment interface 114 configured thereon. The main housing 110 includes a refrigerant compartment 120 for holding the beverage cans 190. The main housing 110 further includes a delivery sub-system 130 for delivering one of the plurality of beverage cans 190 from the refrigerant compartment 120 to the delivery slot 112 of the main housing 110 in a ready to drink state. The delivery sub-system 130 includes a receiving station 132 for receiving the one of the plurality of beverage cans 190 from the refrigerant compartment 120, and an elevator station 134 for delivering the beverage can 190 to the delivery slot 112 of the main housing 110. The delivery sub-system 130 further includes an orienting station 136 functionally positioned between the receiving station 132 and the elevator station. The orienting station 136 orients the beverage can 190 in 134 the top upright position and places onto the elevator station 136. Furthermore, the delivery sub-system 130 includes an opening mechanism 138 for opening the beverage can 190 while it is being delivered from the elevator station 134 towards the delivery slot 112 such that the beverage can 190 is accessible to the consumer in an opened state and is ready to be picked and drink by the consumer.

The machine 100 may further comprise a control unit 140 for controlling the operation of the vending machine 100. In use, in response to a payment made by the consumer at the payment interface 114, the control unit 140 sends an operational instructions refrigerant compartment 120 and the delivery sub-system 130 to deliver the beverage can 190 to the delivery slot 112. Optionally, the control unit 140 may further include an input module (not shown) such as a user interface, to enable the user to communicate with the control unit 140. The input module may include an input means to receive inputs such as related to payment instructions, pin number of various kind of cards used for receiving payments, etc. from the consumer.

FIG. 1 schematically show the arrangement of the basic components of the vending machine 100 of the present disclosure. However, in the construction of commercial functional units, secondary components such as wires, leads, couplers, connectors, support structure and other functional components known to one of skill in the field of thermodynamics and more particularly the vending machine technology may be incorporated within the vending machine 100. Such commercial arrangements are included in the present invention as long as the structural components and arrangements disclosed herein are present.

Figure 2A:
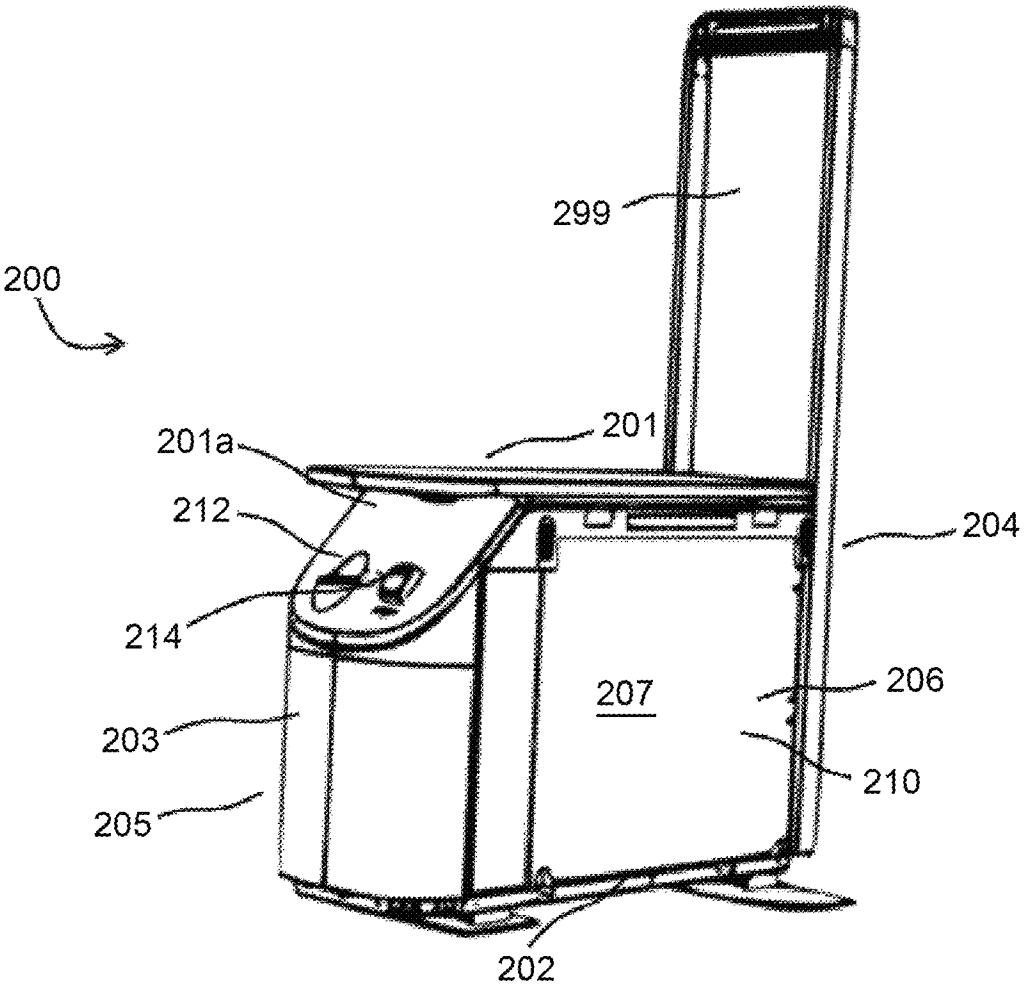
FIG. 2 is a schematic view of the automatic vending machine of FIG. 1, according to one preferred embodiment of the present disclosure.
Figure 2B:
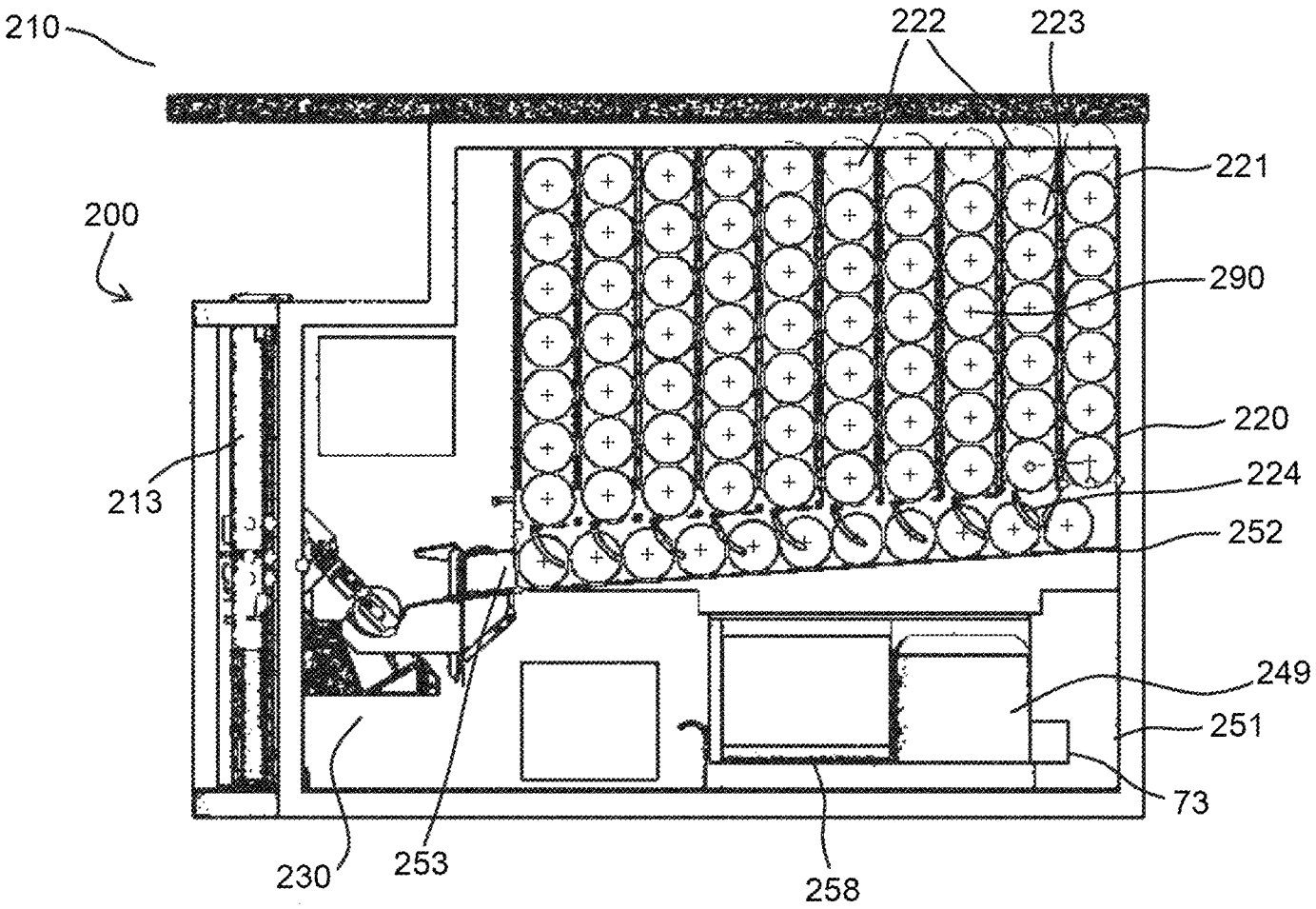

Referring to FIGS. 2*a* and 2*b*, a vending machine 200, generally represented by a numeral 200 for dispensing a generally cylindrical shaped beverage can 290, is illustrated in accordance with an embodiment of the present disclosure. While the shape of the beverage can 290 is cylindrical for exemplary purpose only, it should be understood that the beverage can 290 may be of any shape and size, including the radius and height suitable for enclosing its contents. Further, the shape and size, including the radius and height of the vending machine 200 may be varied depending on the design constraints and requirements for its application, as will be discussed later.

The vending machine 200 includes a main housing 210 having a generally quadrilateral nose shape having, a top portion 201, bottom portion 202, front portion 203, a nose portion 201*a* joining the top portion and the front portion, and a back portion 204 extending between a first side 205 and a second side 206 defining an interior space 207 within the main housing 210. The first side 205 and the second side 206 may be configured as removable door for accessing the interior space 207 of the main housing 210. The main housing 210 includes a delivery slot 212 and a payment interface 214 configured onto a top portion 201 thereof. Further, the vending machine 200 may include a top counter configured onto the top portion 201 and extended towards a generally vertical back-lit banner 299 mounted thereon. The back-lit banner 299 is held by lateral slots [not shown] behind onto the top portion of the vending machine 200. The back-lit banner 299 may be used to display various kind of banners/picture signs/or the like.

The delivery slot 212 is generally an opening slot into the main housing 210 connected to a tubular structure 213 extending into the interior space 207 of the main housing 210 and adapted to receive the beverage can 290 stored within the vending machine 200.

The payment interface 214 is an interface configured to accept payment using a plurality of known mechanism. In an embodiment of the present invention, the payment mechanism may be traditionally accepted coins and occasionally bank notes. In another embodiment, the payment mechanism may be selected from but not limited to credit cards, debit cards and more recently, cash cards, also referred to as smart cards. Further, the mode of payment may also include various prepaid/post paid wallets such as Amazon pay, Google Payments, or the like. For the purpose of receiving the payments in all possible modes, the payment interface 214 is provided with a card reader such as for example, Nayax VPOS Card Reader. Further, the payment interface 214 comprises a serial interface to Telemetry terminal such as amit telemetry terminal for providing a secure communication to Nayax servers and payment gateway. The telemetry gateway includes one or more of Quad band GSM/GPRS/CDMA cellular interface for providing a safe and encrypted connection to remote servers for managing the payments through an antenna and/or transceiver 214*a* of the vending machine 200. Further, such a gateway may be connected to a inventory management system for managing the inventory status of the vending machine 200.

The interior portion 207 of the main housing 210 includes a refrigerant compartment 220 for storing the beverage cans 290 in a cooled state and a delivery sub-system 230 for delivering the beverage can 290 from the refrigerant compartment 220 to the delivery slot 212 through the tubular structure 213.

The refrigerant compartment 220 includes a top compartment 221 for storing the plurality of beverage cans 290 partitioned from a base refrigerant unit 251 through a generally declining plate 252 extending towards a refrigerant door 253 of the refrigerant compartment 220. The base refrigerant unit 251 may be any conventionally known refrigerant unit known in the art, and suitable to be used with the vending machines. In an embodiment of the present invention, the refrigerant unit 251 includes a set of refrigeration coils 258 and a compressor 249 that is commercially available from various companies known in the art. Further, a power supply 73 is housed under the declining plate 252 next to the compressor 249. In use, the set of refrigeration coils 258 supply cooling fluid to cool the top compartment 221. Further, optionally the refrigerant unit 251 may include a cooling fan [not shown] for blowing cool air into the top compartment through one or more openings within the declining plate 252. The refrigeration coils 258 may be periodically heated to prevent ice from forming on the exterior of refrigeration coils 258. A moisture collector unit [not shown] may collect water that drips from refrigeration coils 258 and routes the water through tubing (not shown) out of the vending machine 200, where the water can be left to evaporate or discharged from vending machine 200.

The top compartment includes a plurality of columns 222, each capable of storing a stack 223 of beverage cans 290, and having a release door 224 at a lower portion thereof. The compartment 221 further includes a motor assembly (290) for releasing (opening)/locking (closing) the release door 224. Each of the stack 223 includes a plurality of horizontally placed beverage cans 290 stacked on top of each other. The release door 224 may be released to allow the movement of the beverage cans 290 from each of the stack 223 onto the base declining plate 252 towards the refrigerant door 253 which in turn serves as an entry to the delivery sub-system 230.

Figure 3A:
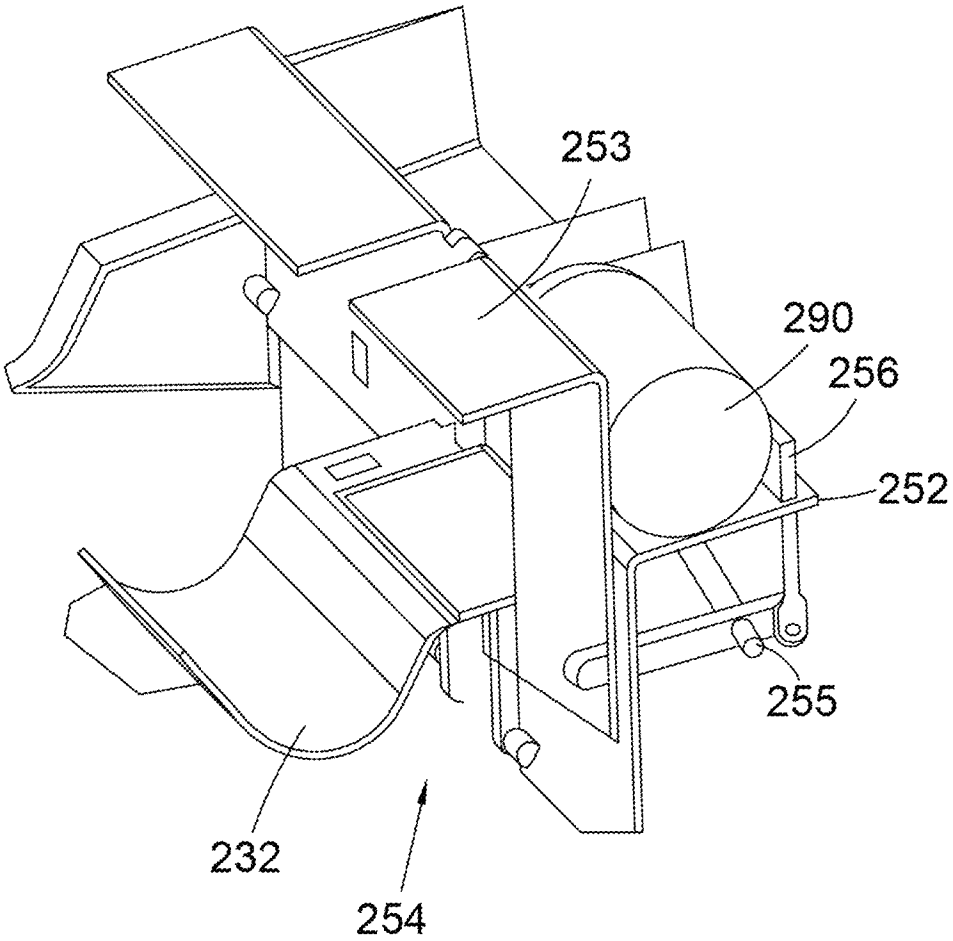
FIG. 3 is a perspective view of the delivery door and door delivery mechanism, according to an embodiment of the present disclosure.
Figure 3B:
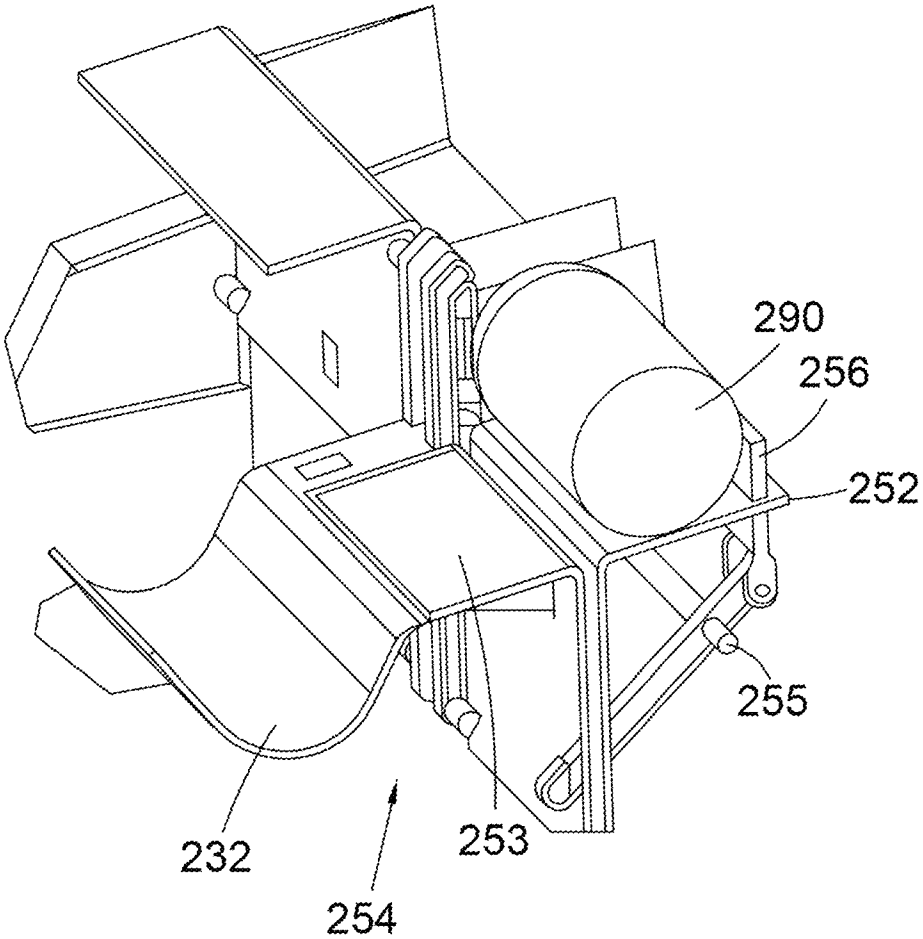

The refrigerant compartment 220 further includes a door opening mechanism 254 as illustrated in FIGS. 3*a* and 3*b*, for opening the door 253 such that only one beverage can 290 may be dispensed out of the refrigerant compartment towards the delivery sub-system 230 at a receiving station 232 thereof.

The door opening mechanism 254 includes a horizontal shaft 255 coupling the door 253 to the motor assembly 290. The door 253 is pivotally connected to a tab shaped barrier 256 extending perpendicularly to the horizontal shaft 255 in a direction away from the door 253. Accordingly, the door 253 is radially coupled to the shaft 255 in a direction opposite to that of the first barrier 256, and at an axial distance corresponding approximately to a diameter of the can 290. Accordingly, when the door 253 is lowered by a 180° rotation of the shaft 255, the tab shaped barrier rises between a first can 290*a* and the second can 290*b* [illustrated in FIG. 4*a*] positioned immediately behind it. As the first can 290 rolls out of the refrigerant compartment 220 through the door opening 253, the second can 290*b* is held back by the tab shaped barrier 256 until the shaft 255 completes a full rotation. Once the shaft 255 completes a full rotation, the door 253 rises across the path of the now lowermost can 290*b* rolls down until it is stopped by the door 253. Further, at this time, the tab shaped barrier 256 is moved down below the declining plate 252. Accordingly, under the pull of gravity, all the remaining cans 290 in the lowermost channel of the refrigerant compartment 220 roll down one position. Such a mechanism is repeated each time the motor is rotated to release the door and in turn dispensing of one beverage can 290 from the refrigerant compartment 220 towards the delivery sub-station 230.

Figure 4A:
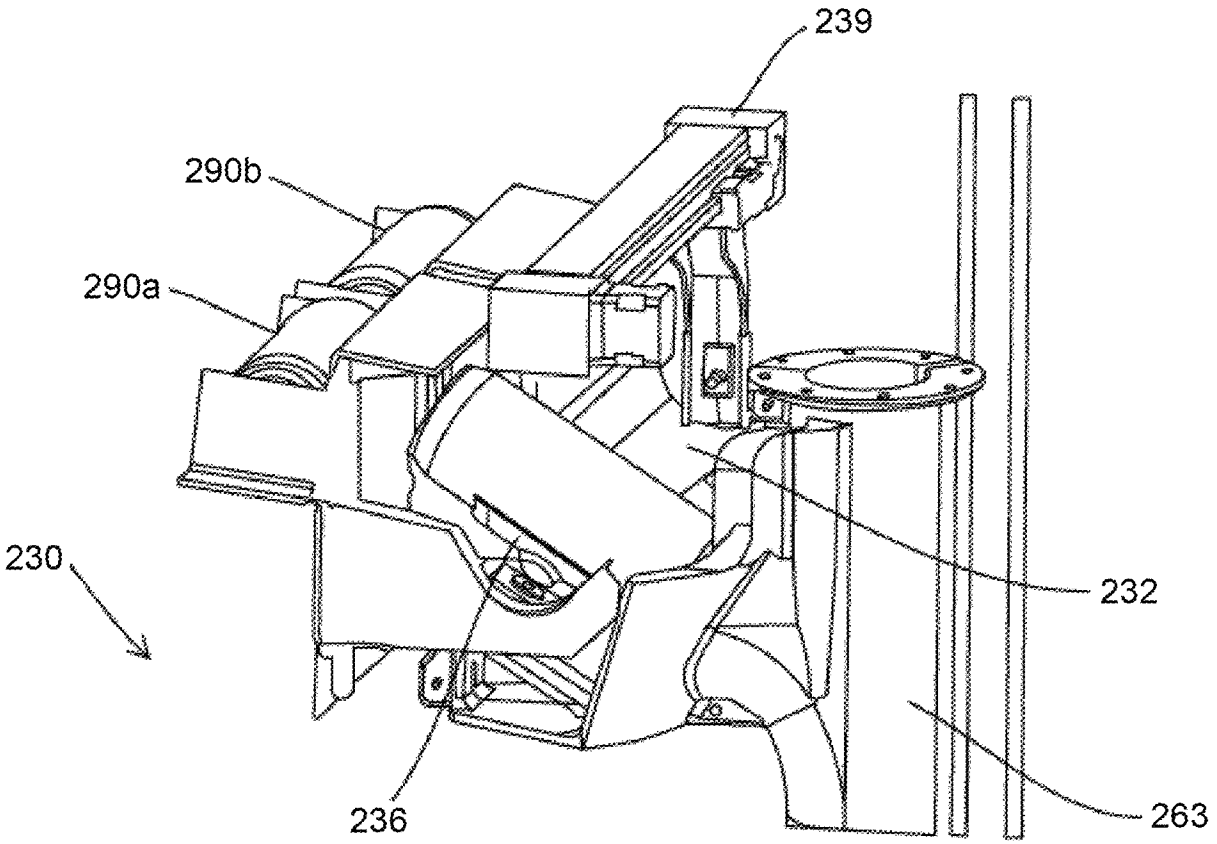
FIG. 4*a* is a schematic view of a receiving station of the delivery sub-system, according to one preferred embodiment of the present disclosure.

As illustrated in FIG. 4*a*, the delivery sub-system 230 as disclosed earlier receives the beverage can 290 at the receiving station 232. The receiving station 232 is generally a trough shaped open case having a diameter adapted to comfortably receive the beverage can 290.

Figure 4B:
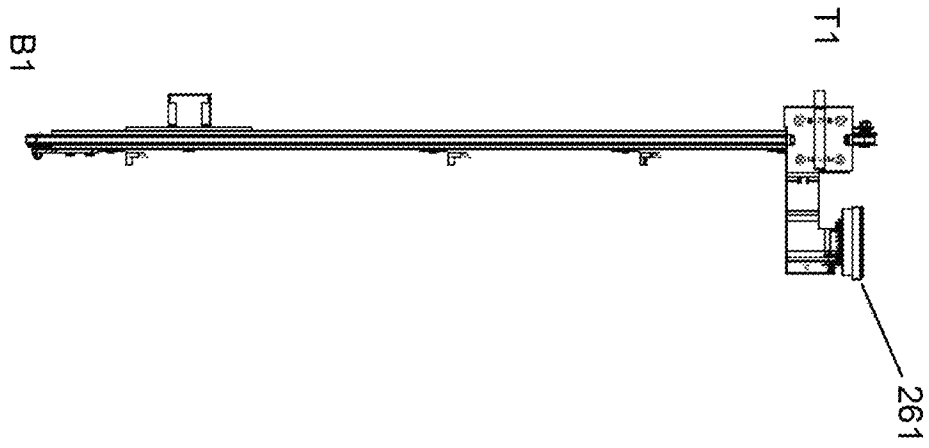
FIG. 4*b* is a front view of elevator of the delivery sub-system, according to one preferred embodiment of the present disclosure.
Figure 4C:
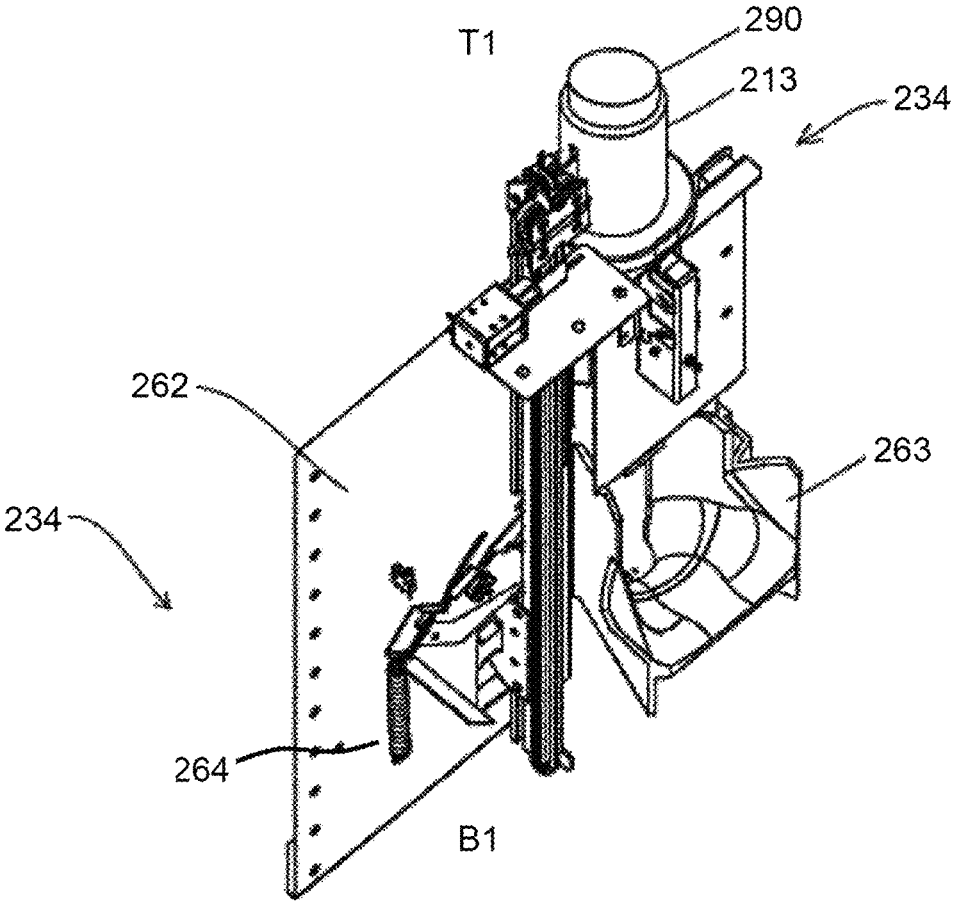
FIG. 4*c* is a schematic view of elevator of the delivery sub-system, according to one preferred embodiment of the present disclosure.

As illustrated in FIGS. 4*b* and 4*c*, the delivery sub-system 230 further includes an elevator station 234 adapted to deliver the beverage can 290 received at the receiving station 232. The elevator station 234 is further adapted to deliver the beverage can 290 to the delivery slot 212. The elevator station 234 includes a base elevator platform 261 rigidly attached to an elevator back plate 262, and an elevator shaft 263 connected to the delivery slot 212 through the tubular structure 213. The elevator station 234 further includes an elevator drive system 264 for vertically moving the elevator platform 261 in an upward and/or downward direction, within the elevator shaft 263. The elevator drive system 264 is generally a DC motor, however, any known suitable mechanism such as, for example, a drive pulley based driving mechanism may be utilized to drive the elevator platform 261.

The elevator platform 261 is adapted to receive the beverage can 290 at a base position and towards a top position T1 of the elevator shaft 263, such that when at the top position T1, the platform 261 is parked at the delivery slot 212 thereby making the can 290 accessible to the consumer. In some embodiments, the elevator station 234 may not include the elevator shaft 263. In such embodiments, the rest of functionality remains same and the elevator platform 261 may be driven by the drive system 264 vertically between the base position B1 and the top position T1 thereof.

The elevator station 234 may be functionally connected to the receiving station 232 through an orienting station 236. The orienting station 236 receives the beverage can 290 from the receiving station 232, orients and places it onto the elevator platform 261 in a top upright direction. The delivery sub-system 230 further includes a transfer mechanism 239 for transferring the beverage can 290 from the receiving station 232. The transferring mechanism 239 [FIG. 4*a*] may be any suitably known transfer mechanism known in the art. In one preferred embodiment, the transfer mechanism 239 may be a drive wheel operated pusher device that senses the presence of the beverage can 290 onto the receiving station 232 and pushes it towards the orienting station 236. In other embodiments, the transfer mechanism 239 may include a motor operated belts known in the art.

Figure 4D:
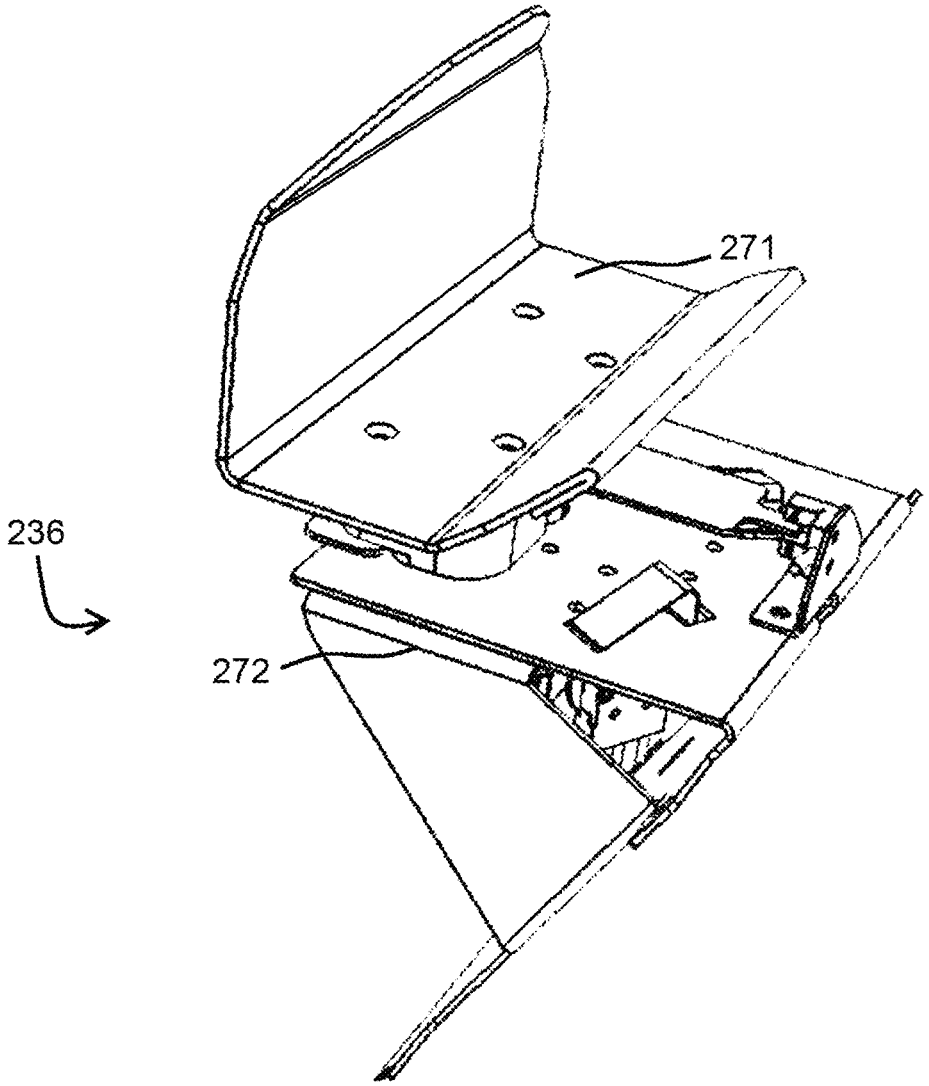
FIG. 4*d* is a schematic view of an orienting station of the delivery sub-system, according to one preferred embodiment of the present disclosure.

The orienting station 236 may be any known mechanism that may be used to suitably detect and change the orientation of the beverage can 290. In one preferred embodiments of the present invention, the orientation station 236 includes a receiving portion [not shown] which receives the beverage can 290 from the receiving station 232. Further, the orientation station 236 a sensing mechanism [not shown] for sensing a current orientation of the beverage can 290, an orienting mechanism [not shown] for changing the orientation of the beverage can 290 and a release mechanism [not shown] for placing the beverage can 290 onto the elevator platform 261 in the top upright direction as desired. For example, in one instance, the orientation station 236 is a cradle based orientation station 236 as illustrated in FIG. 4*d* that orients the can 290 and places it onto the elevator platform 261. In such an embodiment, the orientation station 236 includes a cradle shaped receiving portion 271 extending between a top end and a bottom end, supported onto a support frame 272. The support frame may be adapted to provide a tilting movement and optionally a rotating movement to the receiving station 271. The station 236 further includes a control unit [not shown] having a sensor [not shown] for sensing a top portion 291 of the beverage can 290 received onto the cradle shaped receiving portion 271. The control unit is adapted to receive a sensing information from the sensor and accordingly provide a movement instruction to the support frame 272. In use, the movement instruction includes providing a upward tilting movement to an end of the cradle opposite to the end closer to the elevator platform 271, such that when tilted, the cradle releases the beverage can 290 vertically onto the platform 261. Further, the movement instruction may optionally include providing a rotational movement to the cradle such that the top portion 291 of the can is present onto the end of the cradle opposite to the end closer to the elevator platform 261, thereby assuring that the beverage can is released onto the platform 261 in the top upright orientation.

Figure 5:
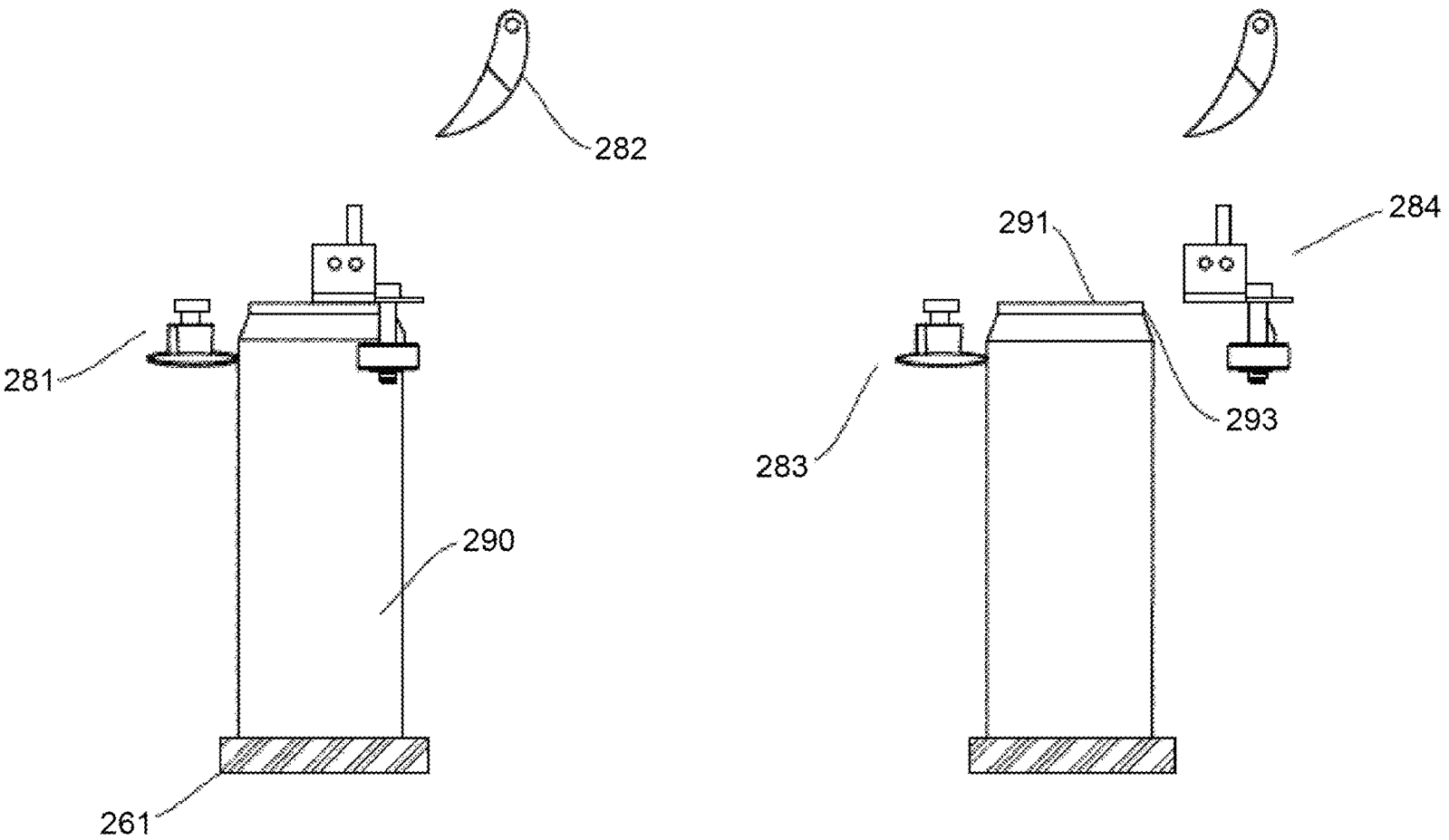
FIG. 5 is a schematic view of opening mechanism of the delivery sub-system, according to one preferred embodiment of the present disclosure.

The delivery sub-system further includes an opening mechanism 280 for opening the beverage can 290 received onto the platform 261 while being delivered from the base position B1 towards the top position T1. The opening mechanism 280 may be any known suitable mechanism known for opening the tab 292 of the beverage cans 290. The opening mechanism 280 may be shifted between an operating position and a non-operating position. In a preferred embodiment as illustrated in FIG. 5, the opening mechanism 280 includes a tab-orienting mechanism 281 for orienting the tab 292 of the can 290 placed onto the elevator platform 261 in a predetermined direction. The opening mechanism 280 further includes one or more opener portion 282 to pull-open the oriented tabs 292 while the platform 261 is moving vertically upwards to deliver the can 290 onto the delivery slot 212. In one such example, the tab orienting mechanism 281 includes a combination of a friction wheel 283, a switch idler 284 and a tab orienting drive motor [not shown]. In such examples, when in the operating position, the friction wheel 283 is allowed to come in contact with the side body 293 and the switch idler 284 is allowed to come in contact with the top portion 291 of the beverage can 290 for sensing the orientation of the tab 292. Further, the opener portion 282 is allowed to be accessed within the elevator shaft 263. The switch idler 284 is oriented in a direction corresponding to the direction of the opener portion 282. In use, the tab orienting drive motor rotates the friction wheel 283 which in turns rotates the beverage can 290. The rotation is continued until the switch idler 284 detects the presence of the tab 292 thereby orienting it in a direction of the tab opener portion 282. Once oriented, the elevator platform 261 is moved up vertically such that during the upward movement, the opener portion 282 engages the tab 292 of the beverage can 290 and pulls it while the platform 261 keeps moving upwardly away from the opener portion 282. In some embodiments, the opener portion 282 may be collapsible radial claws hangingly positioned within the elevator shaft 263 through an opening O. Such radial claws may be adapted to slidingly engage the tab 292 of the can 290. Further, when the can 290 moves away in an upward direction, the claws pivotally pulls the tab 292 thereby opening the can 290. In some embodiments, of the present invention, the opener portion 282 includes a hollow housing body having a diameter greater than the diameter of the beverage can 290. Further, the housing including a plurality of radial claws hangingly disposed across the inner circumference thereof such that atleast one of the radial claw surely engages the tab 292 irrespective of the orientation thereof. In such embodiments, the tab opening mechanism 280 may not include the tab orienting mechanism 281.

The vending machine 200 of the present disclosure may further include a control unit 140 for managing the operations of the vending machine as illustrated in FIG. 1. It may be understood that the control unit 140 may be a computing device, including typical components like, a display unit, a central processing unit (CPU), random access memory (RAM), read-only memory (ROM), at least one stored program, display readouts, and at least one input unit. The control unit 150 is connected to a and refrigerant compartment 220 and delivery sub-system 230 of the vending machine 200. In general, the control unit 140 is adapted to receive operational inputs from a user through the input unit, as well as from the payment interface, and to control the operation of the vending machine 200 based upon the inputs received. Accordingly, the control unit 140 is adapted to instruct refrigerant compartment 220 and all it sub-components such as motor, door delivery mechanism, or the like, to dispense a beverage can 290 to the delivery sub-system 230. Further, the control unit also instructs the delivery sub-system to deliver the beverage can 290 to the delivery slot 212.

The display unit is a visible portion of the control unit 140 and, as is preferably configured onto the top surface of the main housing 210. It may, however, be attached or located at any other position visible and accessible by the consumer. The display unit preferably houses the display readouts, input module, CPU, RAM, and ROM, as well as any programs stored in the RAM or ROM. The display readouts preferably include a signal light and LED readout, but may also include a liquid crystal display (LCD) panel, or the like. The display readout generally signal light outputs for indicators such as a "dispensing in progress" indicator, a "payment successful" indicator, a "can dispensed indicator" indicator, an "error" indicator, an "empty machine" indicator and a "stop" process interrupted indicator. The LED readout preferably includes a "payment pin input" readout, but may also include a "price" readout, a "error message" readout, and operator instructions such as "please select a certain entry option," or the like.

The input module preferably includes a keypad array having alphanumeric entry switches as well as other entry switches, such as selections for the type of payment mode selector, type of container to be selected, and other applicable options.

In some embodiments, the input module and the display readouts are separate entities. In some other embodiments, they may be combined using a touch screen or other input/output mechanism known in the art.

The CPU, RAM, ROM, and program act in concert to evaluate the inputs received and to control the cooling process. The CPU and RAM may be specially manufactured for this invention, or may preferably make us of off-the-shelf items available at the time of manufacture. The ROM may also be specially designed for this invention and may include program instructions. However, PROMs, EPROMs, EEPROMs or the like are preferred, which allow for selective programming, and may be arranged to be programmed even in the field. The RAM is preferably used to temporarily store operator and system inputs, but may also be used to store programming instructions supplemental to the program or programs stored in the ROM. Based on the programming instructions from the ROM or other memory source and the inputs received, the CPU sends outputs to the display panel, as well as to outputs that control various components of the machine 200.

The vending machine 200 further includes a powering unit [not shown] for providing an electric current to the various components thereof. The powering unit 140 generally connects to the control unit 140, the refrigerant unit 220 and the delivery sub-system 230 to provide power to various components such as motors, sensors, display units, input units, and other sub-components thereof.

The powering unit may be connected to an electric socket through a power cord [not shown]. Alternatively, the power cord may terminate in a connector such as a male plug, a female plug, alligator clips, a banana plug, battery connectors, battery adapters, current adapters and other similar devices to connect the vending machine 200 to a mobile power source. The mobile power source may be one of but not limited to a portable battery, solar panel, generator, etc. In some embodiments the powering unit may include an additional integrated power source, such as alkaline batteries, or a rechargeable battery such as a lithium ion or a nickel cadmium battery, or the like. The power source may be removable and/or replaceable within the powering unit.

Figure 6A:
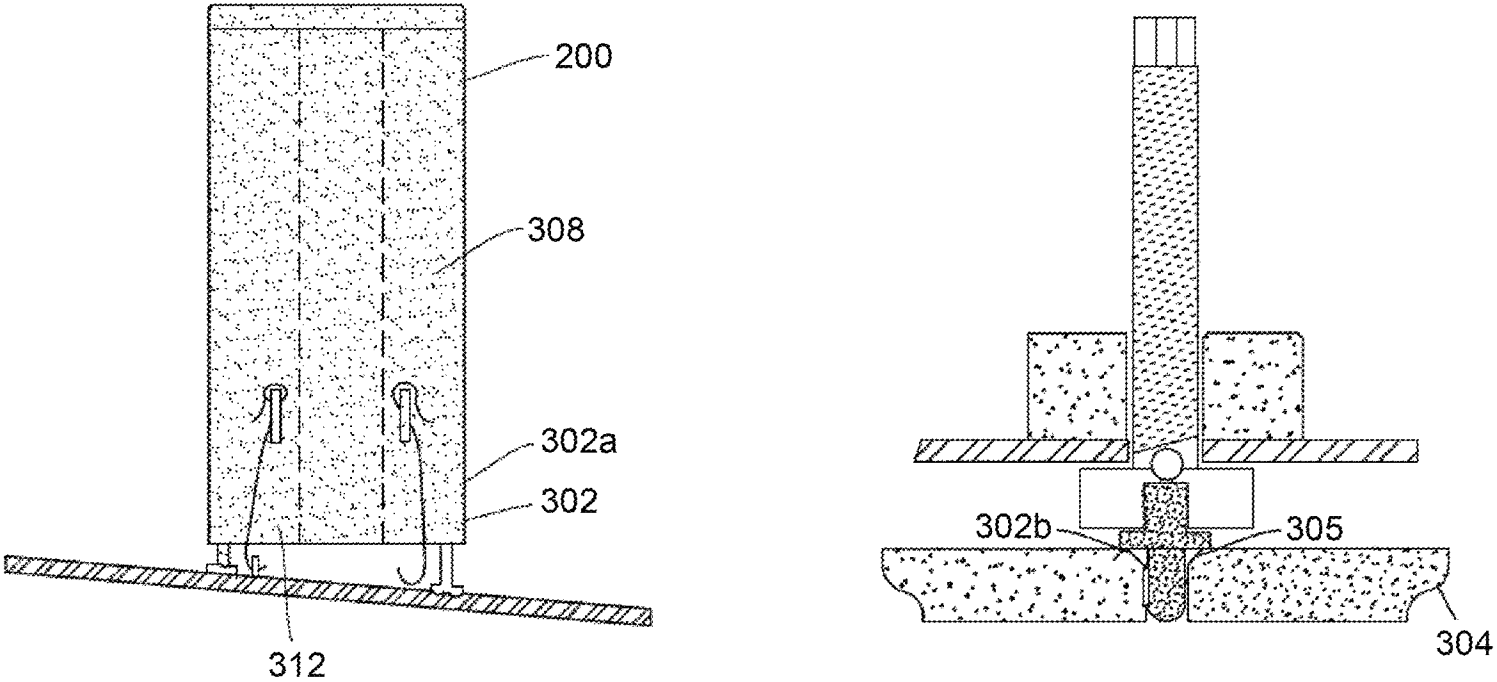
FIG. 6*a* is a schematic view of an installation mechanism, according to one preferred embodiment of the present disclosure.
Figure 6B:
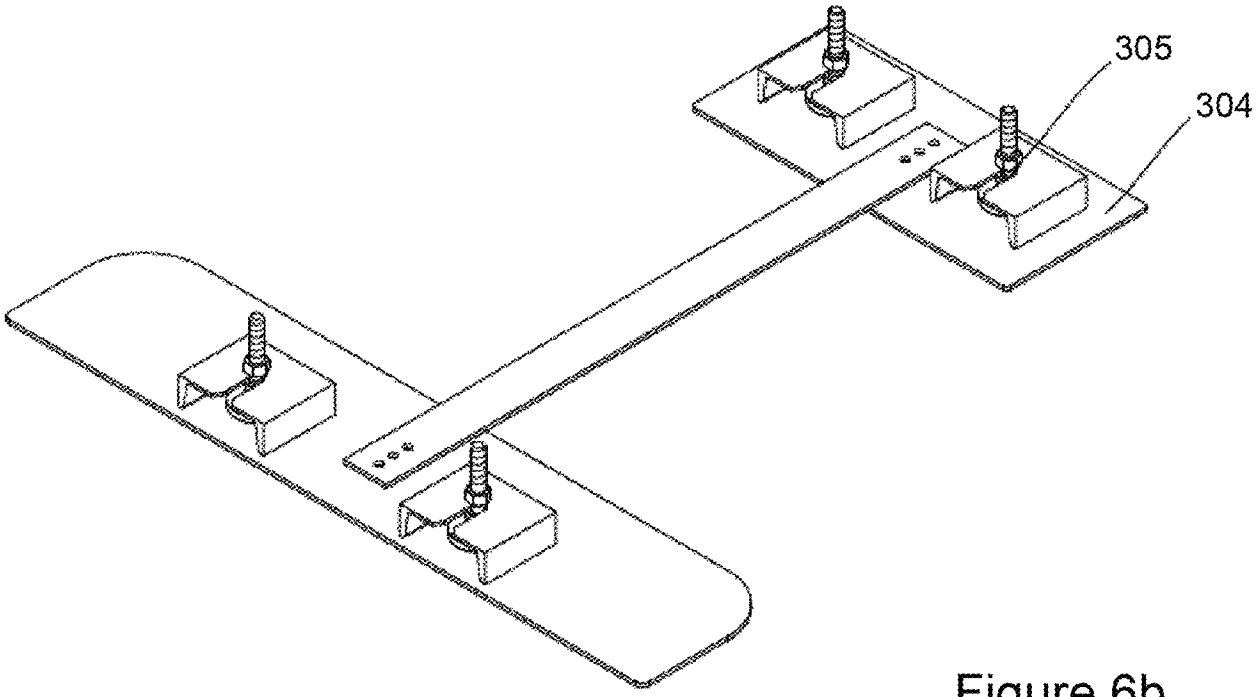
FIG. 6*b* is a schematic view of a base plate, according to one preferred embodiment of the present disclosure.

FIG. 6*a* illustrates an installation mechanism 300 for installing the vending machine 200 onto a desired surface. The installation mechanism 300 includes two or more spaced apart threaded adjuster 302 having a top portion 302*a* attached to the bottom portion of the vending machine 200. Each of the two or more spaced apart threaded adjuster 302 comprises a detachable pin onto a bottom portion 302*b* of the threaded adjuster 302. The installation mechanism 300 further includes a base plate 304 [illustrated in 6*b*] having a plurality of countersunk holes 305 configured therein. In use, the base plate 304 is placed onto the desired surface. Thereafter, the vending machine 200 is placed on to the base plate 304 such that each of the detachable pin engages one of the countersunk hole 305 thereby securing the vending machine 200 onto the base plate. Further, each of the threaded adjuster 302 may be individually adjusted to adjust the leveling/tilting of the vending machine 200. In some embodiments, the vending machine 200 further comprises an attachment means 308, such as for example two or more straps, on the back portion thereof. Further, the attachment means 308 includes a plurality of hooks 312, which may be used to strap down the vending machine 200 onto the base plate 304. Alternatively, the attachment means may be any suitable attachment means known in the art.

In other embodiments of the present invention, any suitably known mechanism may be used for installing the vending machine 200 on to the desired surface as may be understood by a person skilled in the art.

Figure 7:
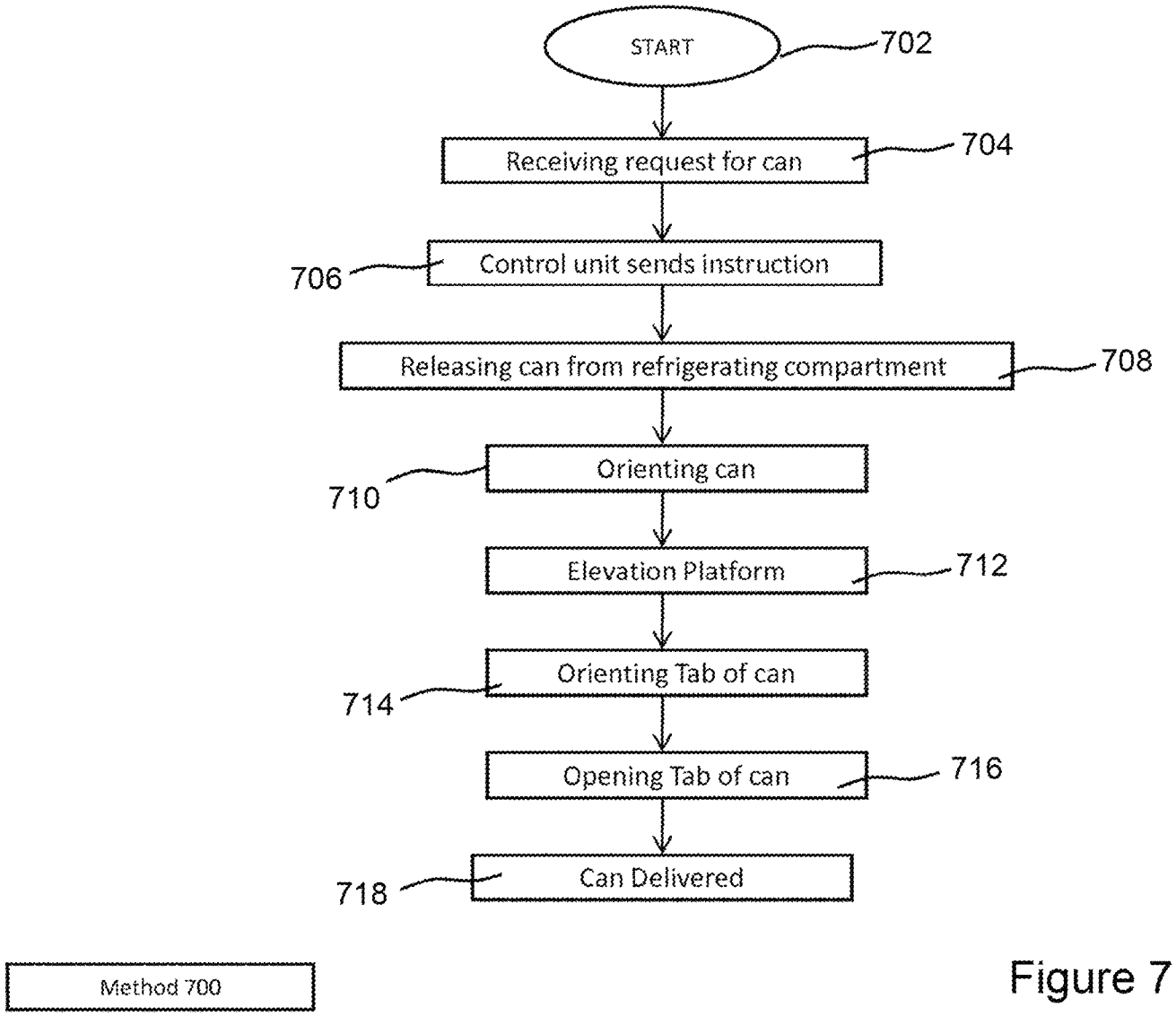
FIG. 7 depicts a flowchart illustrating the steps for delivering an opened beverage can, in accordance with an embodiment of the present disclosure.

FIG. 7 with reference to FIGS. 1 through 6, is a flow diagram illustrating a method of delivering an opened can 290, using the vending machine 200 of the present disclosure. The method starts at step 702 and proceeds to step 704 where a beverage can dispensing request is received from a consumer. The request may be received in the form of payment received by the payment interface 214. Once the payment is confirmed by the payment interface 214, the method proceeds to step 706 where the control unit 140 sends an instruction for dispensing the beverage can 290, to the refrigerant compartment 220 and the delivery sub-system 230. In response to the instruction received from the control unit 140, at step 708, the motor of the plurality of columns 222 within the refrigerant compartment 220 releases a can 290 which in turn also rotates the shaft 255 of the door opening mechanism 254, thereby opening the door 253 such that the outermost beverage can 290 is dispensed from the top compartment 221 into the receiving station 232 of the delivery sub-system 230 where the pusher (transfer mechanism) 239 pushes it towards the orientation station 236 at step 710. Optionally, the pusher 239 may also sense the orientation of the beverage 290 and sends the orientation information to the orienting station 236. The method than proceeds to step 712 where the receiver portion 271 of the orientation station 236 receives the beverage can 290 and under the impact of a tilting movement provided by the support frame 272, drops it onto the elevator platform 261 in a top upright orientation. Once, the can 290 is received onto the elevator platform 261, the method proceeds to step 714 where the tab orienting mechanism 281 becomes operational and orients the tab 292 of the beverage can 290. Thereafter at step 716, the elevator drive system 264 vertically moves the elevator platform 261 towards the delivery slot 212 where on the way, the opener portion 282 of the opening mechanism 280 engages and pulls the tab 292, thereby opening the beverage can 290. The method then proceeds to step 718 where elevator platform 261 moves through the tubular structure 213 and is parked onto the delivery slot 212, thereby making the opened beverage can 290 accessible to the consumer.

INDUSTRIAL APPLICABILITY

The present disclosure relates to vending machine 200 for dispensing a beverage can enclosing liquids, such as beer, wine, cider, hard liquor (e.g., distilled beverage, spirit, liquor, hard alcohol, etc.), soft drinks (e.g., cola, soda, pop, tonic, seltzer), iced tea, soda water and other types of carbonated/non-carbonated beverages. The vending machine 200 could be used to dispense beverage cans of any shape, size or any variety of configurations, in a ready to drink state. Accordingly, the vending machine 200 of the current disclosure orients, and opens the beverage cans before delivering it to the consumer.

Figure 8:
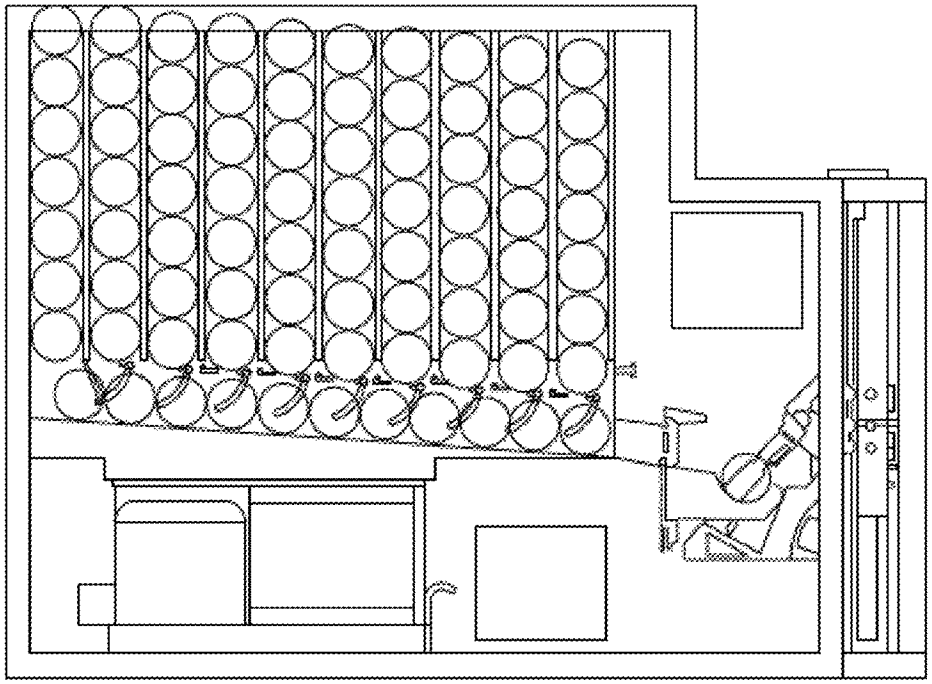
FIG. 8 is a schematic view of a vending machine having a single automatic vending machine, according to one preferred embodiment of the present disclosure
Figure 9:
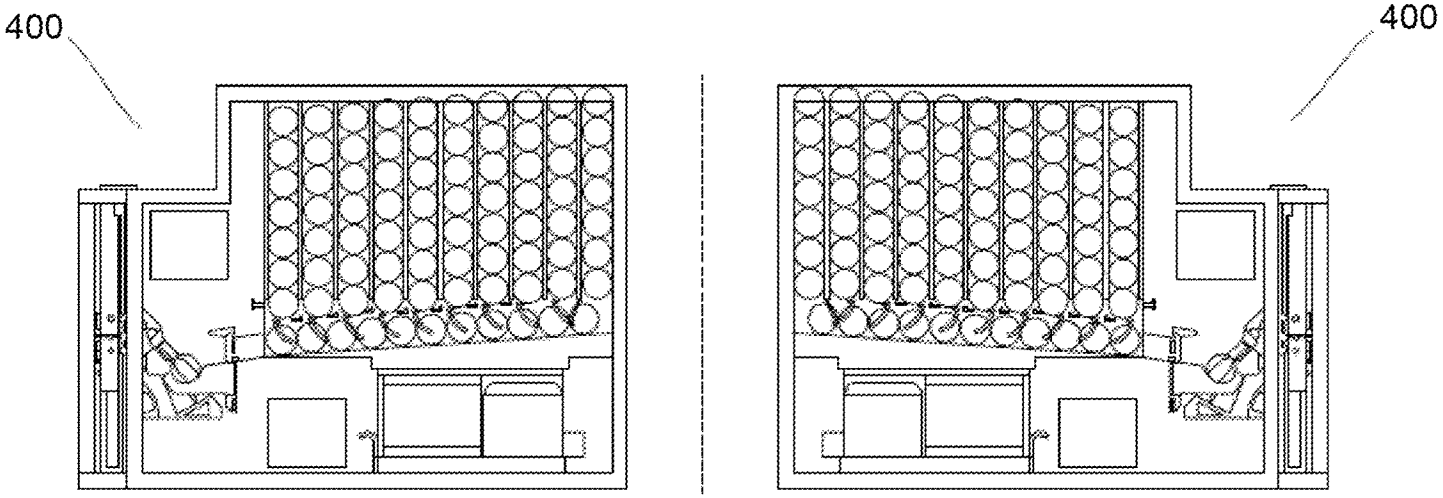
FIG. 9 is a schematic view of a vending machine having a multiple automatic vending machine, according to one preferred embodiment of the present disclosure.

The vending machine 200 is an easy to operate, cost effective and quickly delivering vending machine. Further, the vending machine of the current disclosure accepts all major cash and cashless forms of payment, there enabling it to be easily used by the consumers having their own payment choices FIG. 8 illustrates a vending machine 400 having specific structure in accordance to a preferred embodiment of the present disclosure. While the vending machine 400 include all major components in accordance with the vending machine 200 as disclosed earlier, the machine 400 includes cradle based orienting system and radial claws based opening mechanism as detailed in optional embodiments. The vending machine 400 has a refrigerant compartment which may store a large number of beverage cans, generally approximately 150 in numbers, thereby reducing the requirement of filling the refrigerant compartment frequently. Additionally, in some embodiments, two vending machines may be joined together as illustrated in FIG. 9, thereby further improving the beverage availability at the desired surface.

Throughout the specifications of the present disclosure, the term "comprising" means including but not necessarily to the exclusion of other elements or steps. In other words, the term comprising indicates an open list. Furthermore, all directional references (such as, but not limited to, upper, lower, inner, outer, upward, downward, inwards, outwards, right, left, rightward, leftward, inside, outside, top, bottom, above, below, vertical, horizontal, clockwise, and counter=clockwise, lineal, axial and/or radial, or any other directional and/or similar references) are only used for identification purposes to aid the reader's understanding of illustrative embodiments of the present disclosure, and may not create any limitations, particularly as to the position, orientation, or use unless specifically set forth in the claims. Moreover, all directional references are approximate and should not be interpreted as exact, but rather as describing a general indicator as to an approximate attitude.

Similarly, joinder references (such as, but not limited to, attached, coupled, connected, accommodated, and the like and their derivatives) are to be construed broadly and may include intermediate members between a connection of segments and relative movement between segments. As such, joinder references may not necessarily infer that two segments are directly connected and in fixed relation to each other.

In some instances, components are described with reference to "ends" having a particular characteristic and/or being connected with an-other part. However, those skilled in the art will recognize that the present disclosure is not limited to components which terminate immediately beyond their points of connection with other parts. Thus, the term "end" should be interpreted broadly, in a manner that includes areas adjacent, rearward, forward of, or otherwise near the terminus of a particular segment, link, component, part, member or the like. Additionally, all numerical terms, such as, but not limited to, "second", "second", "third", "fourth", or any other ordinary and/or numerical terms, should also be taken only as identifiers, to assist the reader's understanding of the various embodiments, variations and/or modifications of the present disclosure, and may not create any limitations, particularly as to the order, or preference, of any embodiment, variation and/or modification relative to, or over, another embodiment, variation and/or modification.

As will be readily apparent to those skilled in the art, the present invention may easily be produced in other specific forms without departing from its essential characteristics. The present embodiments is, therefore, to be considered as merely illustrative and not restrictive, the scope of the invention being indicated by the claims rather than the foregoing description, and all changes which come within therefore intended to be embraced therein. Many variations, modifications, additions, and improvements are possible. More generally, embodiments in accordance with the present disclosure have been described in the context of preferred embodiments. Functionalities may be separated or combined in procedures differently in various embodiments of the disclosure or described with different terminology. These and other variations, modifications, additions, and improvements may fall within the scope of the disclosure as defined in the appended claims.

We claim:

1. A vending machine, the machine comprising:

a main housing having a can delivery slot, the housing comprising:

a refrigerant compartment for holding a plurality of cans, each can comprising a tab; and a delivery sub-system for delivering one of the plurality of cans from the refrigerant compartment to the delivery slot of the main housing;

wherein the delivery sub-system orients and opens the can while delivering there through;

wherein the delivery sub-system comprises a receiving station for receiving the can from the refrigerant compartment and an elevator station for delivering the can to the delivery slot;

wherein the delivery sub-system further comprises an orientation station between the receiving station and the elevator station for vertically orienting and placing the can onto a platform of the elevator station;

wherein the delivery sub-system further comprises an opening mechanism for opening the beverage can placed onto the elevator station while the beverage can is being delivered from the elevator station towards the delivery slot, the opening mechanism being configured for opening the tab of the beverage can; and wherein the delivery sub-system delivers the beverage can to the delivery slot in an opened state for picking by a consumer.

2. The vending machine of claim 1, wherein the refrigerant compartment comprises a top compartment for holding the cans and a bottom refrigeration unit for cooling the top compartment.

3. The vending machine of claim 2, wherein the refrigerant compartment comprises a delivery door for delivering the beverage can from the top compartment to the delivery sub-system.

4. The vending machine of claim 3, wherein the housing comprises a door opening mechanism for opening the delivery door of the refrigerant compartment.

5. The vending machine of claim 4, wherein the door opening mechanism comprises a tab shaped barrier pivotally connected to the delivery door such that when the door is opened, the tab shaped barrier is raised thereby allowing only one can out of the refrigerant compartment.

6. The vending machine of claim 1, wherein the delivery sub-system comprises a transferring mechanism for moving the can from the receiving station to the orientation station.

7. The vending machine of claim 6, wherein the transferring mechanism includes a pusher having a sensing means for sensing the orientation of the beverage can.

8. The vending machine of claim 1, wherein the opening mechanism comprises a tab orienting mechanism and one or more opener portions to pull-open the tab.

9. The vending machine of claim 1, wherein a opener portion comprises one or more radial claws configured to engage the tab of oriented cans while moving upon the elevator.

10. The vending machine of claim 1, wherein the main housing comprises a payment interface for receiving the payment there through.

11. The vending machine of claim 1, wherein the main housing comprises a control unit for sending an operational instruction to the refrigerant compartment and the delivery sub-system.

12. A method of delivering an opened can from a vending machine of claim 1, the method comprising:

receiving a request for an opened can; and automatically delivering an oriented and opened can from the refrigerant compartment to the delivery slot via the delivery sub-system.

13. The method of claim 12, wherein the method further comprises generating a can delivery instruction from a control unit to the delivery sub-system in response to the request for the open can.

14. The method of claim 12, wherein the receiving a request for an opened can comprises receiving a payment for the can using the payment interface of the vending machine.

15. The vending machine of claim 1, wherein the orientation station is a cradle based orientation station that orients the can and places it onto the platform of the elevator station, wherein the orientation station comprises a cradle shaped receiving portion extending between a top end and a bottom end, supported onto a support frame, wherein the support frame is adapted to provide a tilting movement, and optionally a rotating movement, to the receiving station.

16. The vending machine of claim 15, wherein the orientation station further comprises a control unit having a sensor for sensing a top portion of the beverage can received onto the cradle shaped receiving portion, said control unit being adapted to receive a sensing information from the sensor and accordingly provide a movement instruction to the support frame, said movement instruction including providing an upward tilting movement to an end of the cradle shaped receiving portion opposite to an end closer to the platform, such that when tilted, the cradle shaped platform release the beverage can vertically onto the platform.

17. The vending machine of claim 16, wherein the movement instruction includes a rotation movement to the cradle shaped receiving portion such that the top portion of the can is present onto the end of the cradle shaped receiving portion opposite to the end closer to the platform, thereby ensuring that the beverage can is released onto the platform in a top upright orientation.

18. The vending machine of any of claim 1, wherein the platform is adapted receive the beverage can at a base position B1 and transport the received beverage can to a top position T1, such that when at the top position T1, the platform is positioned at the delivery slot making the beverage can accessible to a customer, wherein the opening mechanism is adapted for opening the beverage can received onto the platform while being delivered from a base position B1 towards a top position T1.

* * * * *